US005634410A

United States Patent [19]

Wheeler

[11] Patent Number: 5,634,410

[45] Date of Patent: Jun. 3, 1997

[54] WEIGHTABLE TABLE

[75] Inventor: Mark W. Wheeler, Littleton, Mass.

[73] Assignee: ModuForm, Inc., Fitchburg, Mass.

[21] Appl. No.: 645,122

[22] Filed: May 13, 1996

[51] Int. Cl.[6] ..... A47B 13/02

[52] U.S. Cl. ..... 108/150; 108/161

[58] Field of Search ..... 180/150, 153, 180/157, 161; 248/188.1, 188.7

[56] References Cited

U.S. PATENT DOCUMENTS

| | | | |
|---|---|---|---|
| 797,990 | 8/1905 | Treichel | 108/150 X |
| 1,251,661 | 1/1918 | Hendershott . | |
| 1,903,631 | 4/1933 | Morrison . | |
| 1,935,682 | 11/1933 | Wege . | |
| 2,981,578 | 4/1961 | Saarinen . | |
| 3,055,721 | 9/1962 | Holt | 108/150 X |
| 3,230,909 | 1/1966 | Watson | 108/150 |
| 3,399,890 | 9/1968 | Galedrige . | |
| 3,566,808 | 3/1971 | Slate, Jr. et al. . | |
| 3,572,824 | 3/1971 | Schupbach et al. . | |
| 3,664,275 | 5/1972 | Kleinert . | |
| 3,714,908 | 2/1973 | Notko . | |
| 3,742,870 | 7/1973 | Gusdorf et al. | 108/150 |
| 3,742,871 | 7/1973 | Kienel . | |
| 3,853,073 | 12/1974 | Flum et al. . | |
| 3,968,895 | 7/1976 | Barnes, Jr. et al. . | |
| 4,078,757 | 3/1978 | Waters | 108/150 X |
| 4,208,072 | 6/1980 | Iskendarian | 108/150 X |
| 4,214,725 | 7/1980 | Eberle | 108/150 X |
| 4,254,873 | 3/1981 | Cook, III et al. . | |
| 4,289,724 | 9/1981 | Baynard | 108/150 X |
| 4,722,158 | 2/1988 | Urdaneta . | |
| 4,901,998 | 2/1990 | Griffith . | |
| 4,929,021 | 5/1990 | Kaye . | |
| 4,984,406 | 1/1991 | Friesen . | |
| 5,289,783 | 3/1994 | Karl . | |

OTHER PUBLICATIONS

"Slammer Tables," sales brochure, NORIX Group, Inc., pp. 1–2, (Jan., 1994).

"Double Wall Table," sales brochure, NORIX Group, pp. 1–2, (Jan., 1994).

*Primary Examiner*—Jose V. Chen

*Attorney, Agent, or Firm*—Hamilton, Brook, Smith & Reynolds, P.C.

[57] ABSTRACT

A one-piece table base of molded plastic includes at least three hollow upright legs extending outwardly from each other from a central portion. Each leg has at least one side wall. Each side wall has first and second wall portions which are offset from each other and joined together by a first upwardly arching ridge. An upper flange extends from upper portions of the legs for attachment to a table top.

19 Claims, 5 Drawing Sheets

WEIGHTABLE TABLE

BACKGROUND

Tables for use in correctional institutions must include certain features for the safety and health of the inmates using the tables. For example, such tables must be suicide proof, durable, easily cleaned as well as weighted so that they cannot be easily picked up and thrown. In addition, the tables should have a minimum number of pieces which are difficult to remove so that the pieces cannot be used as weapons. Finally, the tables should be easily transportable from the factory to the correctional institution since such tables are typically ordered in large numbers.

SUMMARY OF THE INVENTION

The present invention provides a table for use in a correctional institution which includes a table base comprising a one-piece base form of molded material. The base form is of hollow construction with at least one radially extending side wall. The side wall has first and second wall portions joined together by a first upwardly arching ridge extending from a bottom wall. The first and second wall portions are offset from each other.

In preferred embodiments, the table base is fillable with ballast and has four hollow upright legs equidistant from each other extending radially outward from a central tubular portion. An upper flange extends from upper portions of the legs for attachment to a table top. Each leg has two side walls located on opposite sides of the leg which are joined to a bottom wall. Each side wall includes first and second substantially planar wall portions which are offset from each other and joined together by a first upwardly arching ridge. A third substantially planar wall portion is offset from the second wall portion and joined to the second wall portion by a second upwardly arching ridge. The first and second ridges arch upwardly from the bottom wall of each leg. The first ridge on each leg extends from the junction of the first wall portion, the second wall portion and the bottom wall on one side wall, and continues to the junction of the first wall portion, the second wall portion and the bottom wall on the opposite side wall. The second ridge on each leg extends from the junction of the second wall portion, the third wall portion and the bottom wall on one side wall, continuing to the opposite side wall and arching downwardly to the junction of the second wall portion, the third wall portion and the bottom wall on the opposite side wall. The opposing side walls of each leg taper toward each other such that each leg has upper portions that are wider than lower portions. Additionally, each leg has portions near the central portion that are wider than outwardly located portions.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

Figure 1:
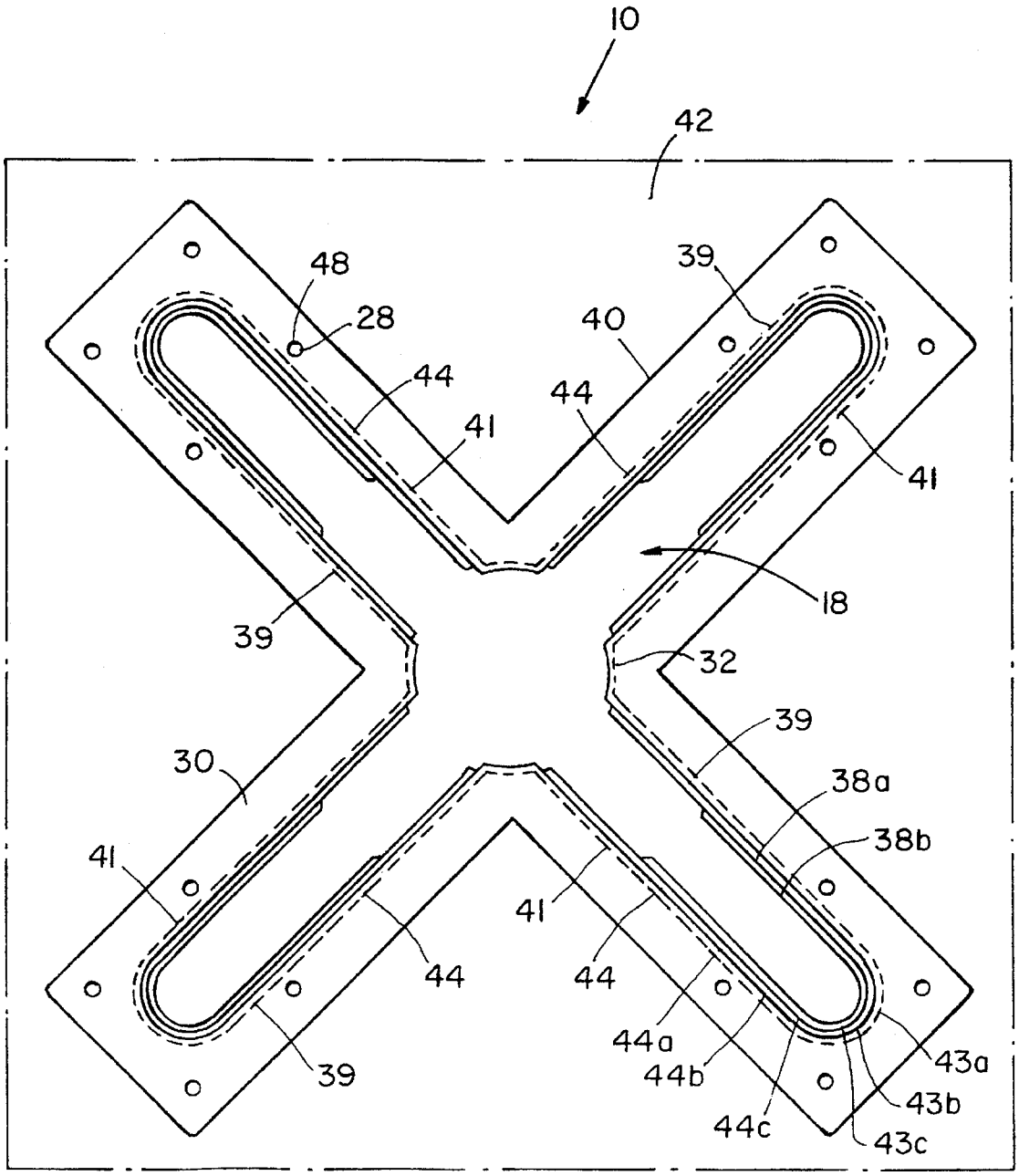
FIG. 1 is a plan view of the present invention table wherein the table top is shown in phantom.
Figure 2:
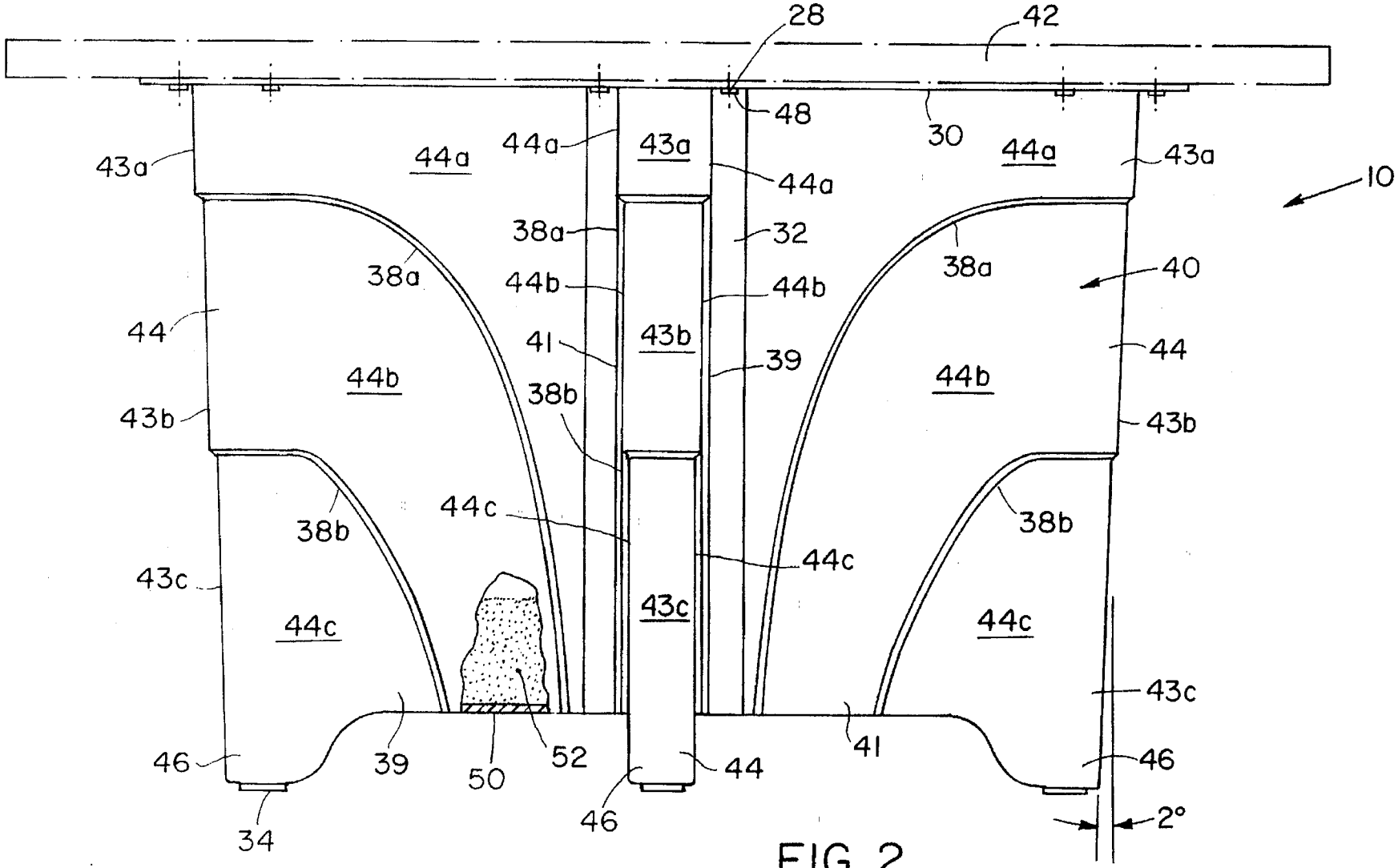
FIG. 2 is a side view of the table of FIG. 1 in which a portion is broken away to show ballast within the base of the table.

Referring to FIGS. 1 and 2, table 10 includes a table top 42 which is attached to a base 40. Table top 42 is preferably a square particle board core/laminate table top. Base 40 is a single piece of molded plastic. Base 40 has an inner cavity 18, thereby making base 40 hollow. Cavity 18 is filled with a quantity of ballast 52, such as sand to increase the weight of table 10 for stability and so that table 10 cannot be easily picked up and thrown.

Base 40 includes four equally spaced upright legs 44 extending away from a central tubular portion 32 such that base 40 has a cruciform or X-shaped appearance when viewed from above. The X-shaped base 40 prevents inmates in correctional institutions from touching each other or passing articles to each other beneath the table top. Cavity 18 extends from central portion 32 into each leg 44. An upper flange 30 extends from the upper portions of legs 44 and has a series of holes 28 drilled therethrough to allow table top 42 to be secured to base 40 preferably with tamper resistant fasteners 48. The lower portion of each leg 44 includes a foot 46. A resilient pad 34 is positioned on the bottom of each foot 46 to assist in leveling table 10.

Each leg 44 has two side walls 39 and 41 located on opposite sides of the legs. Side walls 39 and 41 preferably have a wall thickness of about ¼ inch. Each side wall 39 and 41 has substantially vertical planar wall portions 44*a*, 44*b* and 44*c* which are connected in series with each other and are laterally offset from each other by arching ridges 38*a* and 38*b*. Wall portions 44*a*, 44*b* and 44*c* join with respective rounded extremity portions 43*a*, 43*b* and 43*c* at the outer extremities of legs 44. Extremity portions 43*a*, 43*b* and 43*c* are also joined and offset from each other by ridges 38*a* and 38*b*. The extremity portions on each leg 44 join respective wall portions which are on one side wall 39 with corresponding wall portions on the opposite side wall 41. Wall portions 44*a* and extremity portions 43*a* extend upwardly into upper flange 30. Additionally, wall portions 44*c* and extremity portions 43*c* extend downwardly into feet 46. Bottom wall 50 also joins side walls 39 and 41 together and arches upwardly from feet 46 to central portion 32.

Ridges 38*a* and 38*b* provide side walls 39 and 41 with strength and rigidity. Each ridge 38*a*/38*b* extends across both side walls 39 and 41. For example, on each leg 44, ridges 38*a* and 38*b* begin at the bottom wall 50 from a near vertical orientation and arch upwardly across side wall 39 diverging slightly away from each other. Ridge 38*a* begins at the junction of wall portion 44*a*, wall portion 44*b* and bottom wall 50 while ridge 38*b* begins at the junction of wall portion 44*b*, wall portion 44*c* and bottom wall 50. The ridges 38*a* and 38*b* become horizontal at the outer extremity of each leg 44, extend to the opposite side wall 41 of the leg 44 and arch downwardly in mirror image across side wall 41 to bottom wall 50. The horizontal portion of ridges 38*a* and 38*b* are parallel to each other and separate extremity portions 43*a*, 43*b* and 43*c* from each other. Ridges 38*a* and 38*b* not only provide side walls 39 and 41 with strength and rigidity in the lateral direction but the arched design also provides strength in the vertical direction much like an arched bridge. Although ridges 38*a* and 38*b* preferably diverge slightly from each other across side walls 39 and 41, alternatively, ridges 38*a* and 38*b* can be parallel to each other.

Wall portions 44*a*, 44*b* and 44*c* are laterally offset inwardly from each other by ridges 38*a* and 38*b* about ¼ inch. In addition, extremity portions 43*a*, 43*b* and 43*c* are also offset inwardly from each other by ridges 38*a* and 38*b* about ¼ inch. Each extremity portion 43*a*, 43*b* and 43*c* has a downwardly inward taper of 2° The 2° taper allows base 40 to be removed more easily from the mold and also makes the base 40 look less boxy. Offsetting the wall portions makes the legs 44 of base 40 generally wider at the inner/upper portions of legs 44 (wall portions 44*a*) and narrowest at the outer/lower portions (wall portions 44*c*). In addition, offsetting the extremity portions and providing the 2° taper makes the radial length of the legs 44 shorter at the lower portion of legs 44 than at the upper portion. Although ridges 38*a* and 38*b* preferably offset the wall and extremity portions by about ¼ of an inch, the offset can alternatively be more or less than ¼ of an inch. Finally, the wall thickness of side walls 39 and 41 can be more or less than ¼ inch.

The ballast 52 within cavity 18 is typically sand. Legs 44 allow a portion of the ballast 52 to be positioned at various locations away from central portion 32 to stabilize base 40. Usually, at least 250 lbs. of ballast is required to make table 10 difficult to pick up and throw. Alternatively, other suitable forms of ballast such as cement, steel shot or lead shot can be used. The tables 10 are typically assembled on location and filled with ballast 52 during assembly. As a result, the tables 10 are easily transportable since unassembled tables 10 are relatively light weight and the components can be stacked and nested together.

Base 40 is preferably rotationally molded from a low density polyethylene containing a fire retardant and is about 28 inches high and 40 inches wide. As a result, base 40 can be cleaned by spraying with water and is virtually indestructible. Alternatively, base 40 can be of any other suitable dimensions and can be made of medium density polyethylene or cross linked polyethylene. Additionally, base 40 can be injection molded using polypropylene or nylon. Although table top 42 is preferably a square particle board core/laminate table top, alternatively, table top 42 can also be round, oval, hexagonal, etc. and can also be made of other suitable materials such as stainless steel, wood or plastic.

Figure 3:
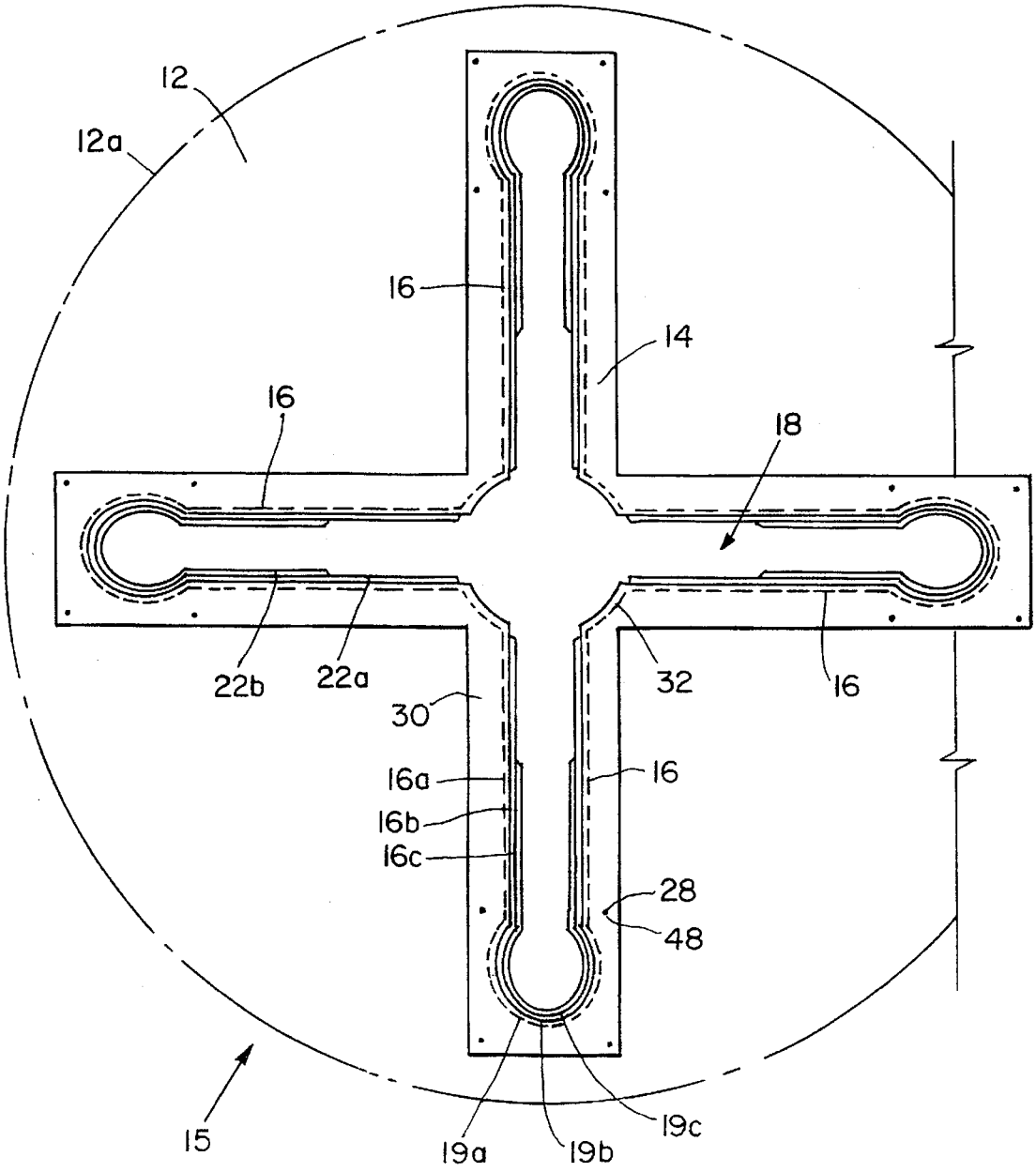
FIG. 3 is a plan view of another preferred table wherein the table top is shown in phantom.
Figure 4:
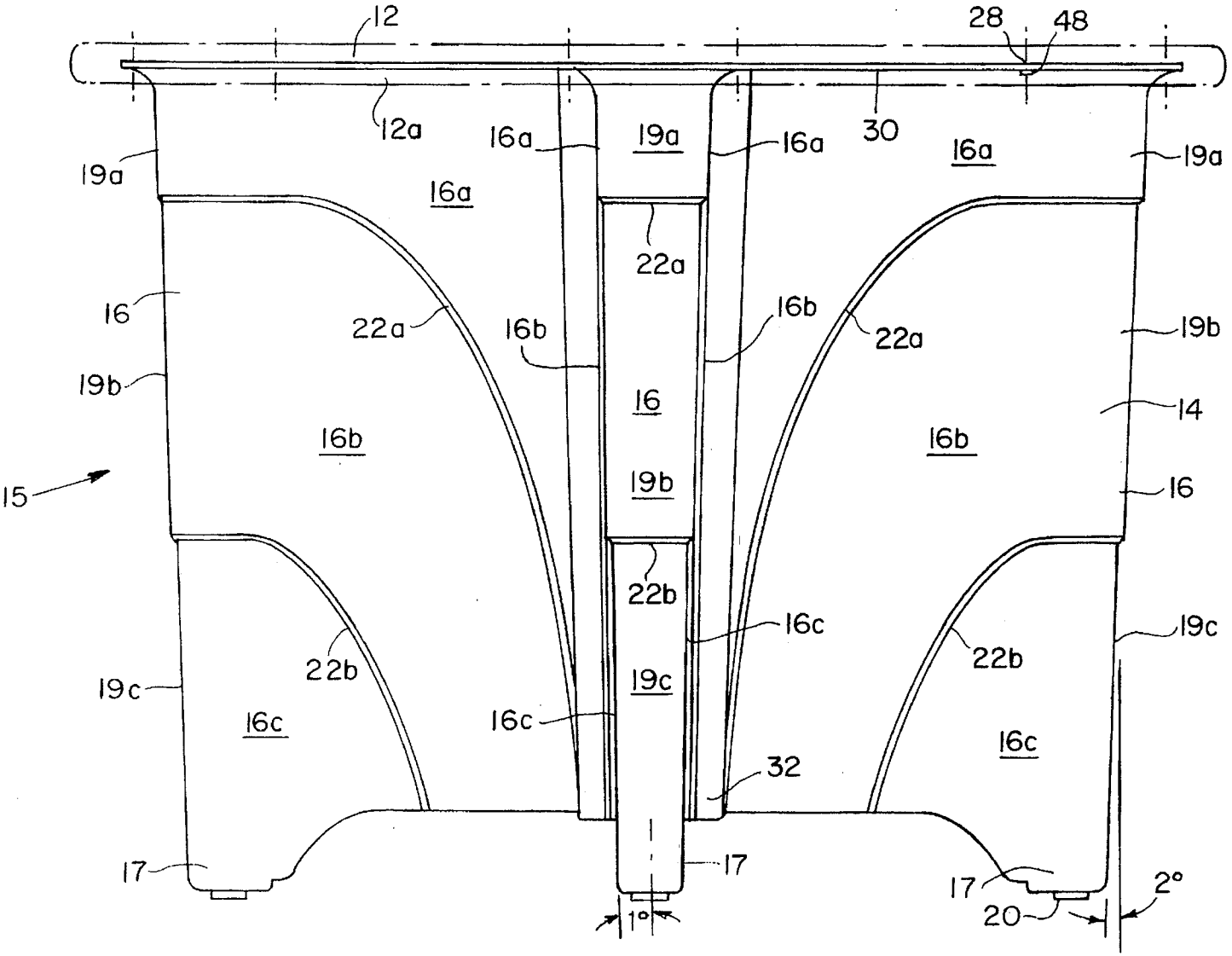
FIG. 4 is a side view of the table of FIG. 3.

Referring to FIGS. 3 and 4, table 15 is another preferred table. Table 15 differs from table 10 in that table top 12 is round and has a bull-nosed edge 12*a* at the edge of the table top 12 which extends below upper flange 30. Base 14 includes four legs 16, each having feet 17 with adjustable leveling pads 20. Legs 16 have wall portions 16*a*, 16*b* and 16*c* which are joined to each other and offset by ridges 22*a* and 22*b*. Ridges 22*a* and 22*b* offset wall portions 16*a*, 16*b* and 16*c* about ⅜ of an inch from each other. Extremity portions 19*a*, 19*b* and 19*c* bulge slightly outwardly on the sides (as seen in FIG. 3) to provide additional strength and rigidity to the side walls of legs 16. The extremity portions 19*a*, 19*b* and 19*c* of legs 16 include the same 2° taper as in base 40. However, in addition, wall portions 16*a*, 16*b* and 16*c* also taper downwardly and inward at about 1°.

Figure 5:
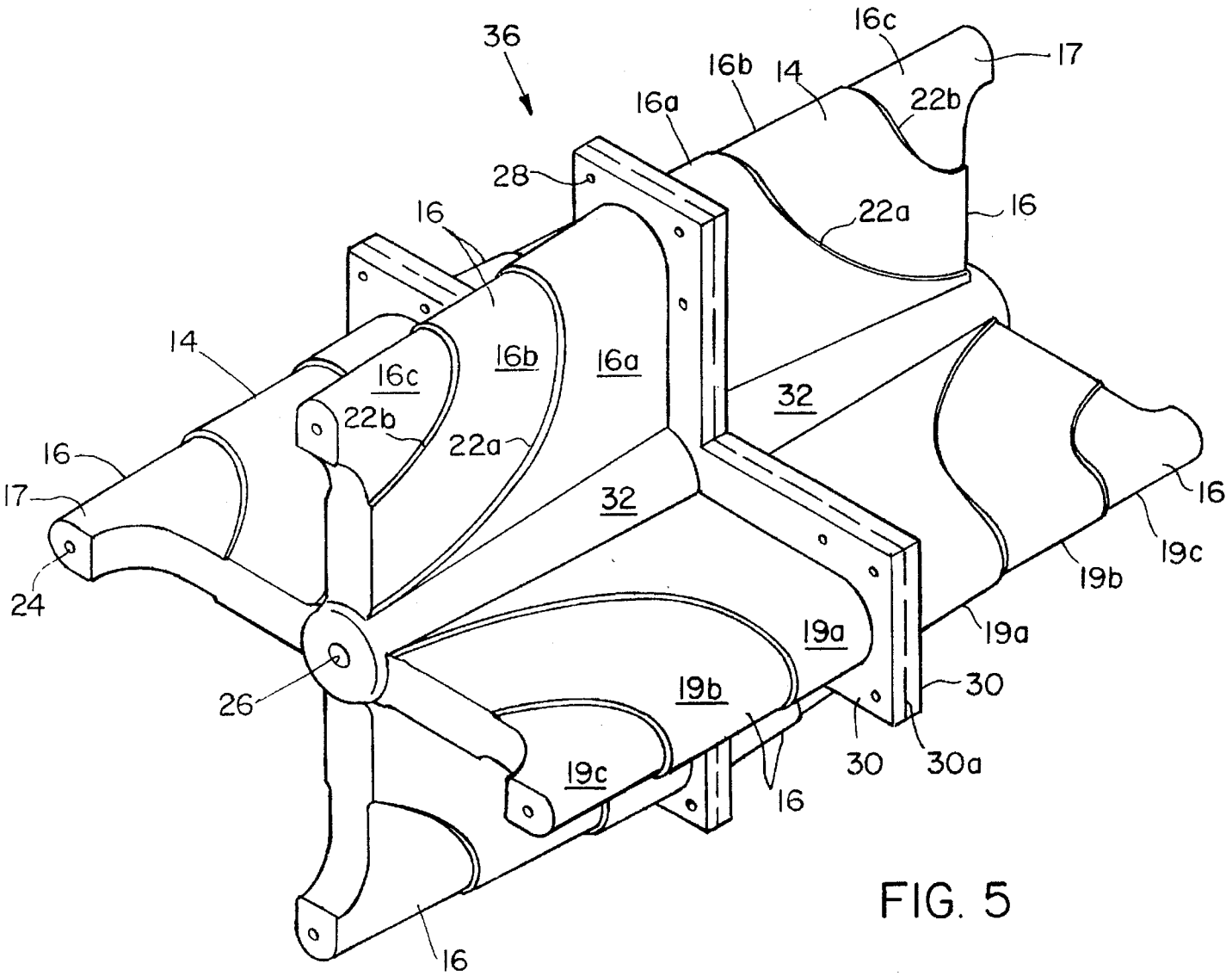
FIG. 5 is a perspective view of two table bases 14 that are molded together.

Referring to FIG. 5, table base 14 is rotationally molded in a double part mold. The double part mold allows two bases 14 to be molded at the same time. The two bases 14 are joined together at the upper flanges 30 by a ribbon of flashing 30*a*. The flashing ribbon 30*a* is later cut off to separate the two bases 14. The double part mold includes cores for forming holes 28 in upper flange 30 and holes or inserts 24 on legs 16 for attachment of the adjustable leveling pads 20. Additionally, the mold includes a core for forming a bottom hole 26 in central portion 32 which enables base 14 to be filled with ballast from the bottom. In such a case, a plug is used to plug hole 26 after base 14 is filled. Alternatively, base 14 can be molded in a single part mold and holes 28, 20 and 26 can be omitted from the molded part. In such a case, holes 28 would later by added by drilling.

EQUIVALENTS

While this invention has been particularly shown and described with references to preferred embodiments thereof, it will be understood by those skilled in the art that various changes in form and details may be made therein without departing from the spirit and scope of the invention as defined by the appended claims. For example, the present invention table is not limited to use in correctional institutions, but is also suitable for use in schools, restaurants or at home. In addition, although bases 40 and 14 are shown having legs with two ridges and three wall portions, alternatively, the number of ridges and wall portions can be more or less. Furthermore, although the arch of the ridges is preferred as depicted in the figures, other suitable arch configurations can be employed.

What is claimed is:

1. A table base comprising a one piece base form of molded material, the base form being of hollow construction with at least one radially extending side wall, said side wall having first and second wall portions joined together by a first upwardly arching ridge extending from a bottom wall, the first and second wall portions being laterally offset from each other with the first ridge having a width extending between the first and second wall portions.

2. The table base of claim 1 in which the base form further includes an upper flange for attachment to a table top.

3. The table base of claim 1 in which the base form is fillable with ballast.

4. The table base of claim 1 in which said side wall further comprises a third wall portion offset from the second wall portion and joined to the second wall portion by a second upwardly arching ridge.

5. The table base of claim 1 in which the first and second wall portions are substantially planar.

6. A table base comprising a base form with a hollow central portion of tubular construction including hollow legs extending radially from the hollow central portion, each leg comprising two side walls positioned on opposite sides of the leg, each side wall having first and second wall portions joined together by an upwardly extending arching ridge, said ridge extending from a junction of the first wall portion, the second wall portion and a bottom wall on one side wall of each leg to the junction of the first wall portion, the second wall portion and the bottom wall on the opposite side wall, said ridge having a width extending between the first and second wall portions.

7. A one piece table base of molded material comprising:

at least three hollow upright legs extending outwardly away from each other from a central portion, each leg having at least one side wall, each side wall having first and second wall portions which are laterally offset from each other and joined together by a first upwardly arching ridge, the first ridge having a width extending between the first and second wall portions; and an upper flange extending from upper portions of the legs for attachment to a table top.

8. The table base of claim 7 in which each side wall further comprises a third wall portion offset from the second wall portion and joined to the second wall portion by a second upwardly arching ridge.

9. The table base of claim 8 in which there are two side walls located on opposite sides of each leg.

10. The table base of claim 9 in which the two side walls of each leg are joined to a bottom wall.

11. The table base of claim 10 in which the first and second ridges arch upwardly from the bottom wall of each leg.

12. The table base of claim 9 in which the opposing side walls of each leg taper toward each other.

13. The table base of claim 12 in which each leg has upper portions that are wider than lower portions.

14. The table base of claim 13 in which each leg has a portion near the central portion that is wider than an outwardly located portion.

15. The table base of claim 8 in which the first and second wall portions are substantially planar.

16. The table base of claim 8 in which the table base has four legs which are equidistant from each other.

17. A hollow one piece table leg of molded material comprising two side walls positioned on opposite sides of the leg and joined together by a bottom wall, each side wall having first and second wall portions which are laterally offset from each other and joined together by an upwardly extending arching ridge, said ridge extending from a junction of the first wall portion, the second wall portion and the bottom wall on one side wall of the leg to the junction of the first wall portion, the second wall portion and the bottom wall on the opposite side, said ridge having a width extending between the first and second wall portions.

18. A method of making a table base comprising the steps of:

forming a hollow one piece base form of molded material, the base form having at least one side wall with first and second wall portions; and laterally offsetting the first and second wall portions from each other and joining said first and second wall portions together with a first upwardly arching ridge extending from a bottom wall, the first ridge having a width extending between the first and second wall portions.

19. The method of claim 18 further comprising the step of offsetting a third wall portion from the second wall portion with a second upwardly arching ridge.

* * * * *